US010477985B2

(12) United States Patent
Neelagantan et al.

(10) Patent No.: US 10,477,985 B2
(45) Date of Patent: Nov. 19, 2019

(54) REFRIGERATION DISPLAY CASES WITH IMPROVED COIL COVERS

(71) Applicant: KYSOR WARREN EPTA US CORPORATION, Columbus, GA (US)

(72) Inventors: Chera Selvan Neelagantan, Columbus, GA (US); Michael Smith, Phenix City, AL (US); Vinod Kunchala, Columbus, GA (US)

(73) Assignee: Kysor Warren EPTA US Corporation, Columbus, GA (US)

( * ) Notice: Subject to any disclaimer, the term of this patent is extended or adjusted under 35 U.S.C. 154(b) by 650 days.

(21) Appl. No.: 15/181,361

(22) Filed: Jun. 13, 2016

(65) Prior Publication Data

US 2017/0354271 A1 Dec. 14, 2017

(51) Int. Cl.
*A47F 3/04* (2006.01)
*F25D 23/00* (2006.01)

(52) U.S. Cl.
CPC ..... *A47F 3/0439* (2013.01); *F25D 23/006* (2013.01)

(58) Field of Classification Search
CPC .... A47F 3/0469; A47F 3/0439; A47F 3/0447; F25D 23/065; F25D 23/006; B65D 11/18; B65D 11/1833
USPC ..... 220/810, 836, 842, 6
See application file for complete search history.

(56) References Cited

U.S. PATENT DOCUMENTS 5,475,988 A * 12/1995 McGovern ..... A47F 3/0447 62/256

* cited by examiner

*Primary Examiner* — Henry T Crenshaw
*Assistant Examiner* — Kamran Tavakoldavani
(74) *Attorney, Agent, or Firm* — Meunier Carlin & Curfman LLC

(57) ABSTRACT

A refrigeration display case for refrigerating and displaying perishable goods includes a plurality of evaporator coils for cooling air, a display case frame forming a display area, and a coil cover for at least substantially covering a portion of the plurality of evaporator coils and coupled to the display case frame. The coil cover includes a planar member having a living hinge formed in the planar member extending from a first side end to a second end and defining a first portion of the planar member and a second portion of the planar. The living hinge is configured to allow movement between the first portion of the planar member and the second portion of the planar member. Other embodiments and designs are included.

20 Claims, 5 Drawing Sheets

REFRIGERATION DISPLAY CASES WITH IMPROVED COIL COVERS

TECHNICAL FIELD

This application is directed to refrigeration display cases with improved coil covers.

BACKGROUND

Grocery stores and other purveyors of perishable goods often use refrigerator display cases to refrigerate and display the goods. Typically, the refrigerator display cases are vertical units with open fronts that allow consumers to view the goods and to reach into the case to retrieve the goods. Such systems typically have evaporator coils at a lower portion, and air is forced over the evaporator coils to create a cooled airstream. The cooled airstream is forced along an interior wall with some of the cooled airstream being distributed at various levels and portion reaching the top from where it is directed down a front portion of the display case to create a curtain of cool air. At times, the evaporator coils must be accessed and this can involve various issues.

SUMMARY

According to one illustrative embodiment, a refrigeration display case is formed with an interior display area for displaying and providing access to perishable goods. The display case causes air to flow over a plurality of evaporator coils and then along a back wall before being directed downward as a curtain air at a front portion of the refrigeration display case. A coil cover is formed that interfaces with a fan plenum and with a portion of a base member or back wall to substantially cover the plurality of evaporator coils, but also to provide easy access to the coils by using a living hinge. The living hinge is made typically from the same material as other portions of the coil cover, but is thinned or otherwise configured to allow relative movement between two parts of the coil cover. The coil cover may also include a sealing member to substantially seal off airflow escaping between the coil cover and the fan plenum. The coil cover may also include a releasable holding device to hold a portion of the coil cover in an open position while the plurality of coils is accessed.

According to one illustrative embodiment, a refrigeration display case for refrigerating and displaying perishable goods, the refrigeration display case includes a base member, a back wall coupled to the base member, and a top member coupled to the back wall. The base member, back wall, and top member form an interior display area in which the perishable goods are displayed. The base member includes at least one fan plenum associated with at least one fan, a plurality of evaporator coils have a top portion and a bottom portion, and a coil cover. The at least one fan plenum and at least one fan are configured to direct air over the plurality evaporator coils. The coil cover includes a planar member having a first end, a second end, a first side end, and a second side end. The coil cover is configured to substantially cover the top portion of the plurality of evaporator coils. The coil cover also includes an attachment member coupled to the second end of the planar member for coupling the planar member to the base member or back wall, and the coil cover includes a living hinge formed in the planar member and extending from the first side to the second side for allowing a first portion of the planar member assume an angle greater than 45 degrees with respect to a second portion of the planar member.

According to one illustrative embodiment, a refrigeration display case for refrigerating and displaying perishable goods includes a plurality of evaporator coils for cooling air, a display case frame forming a display area, and a coil cover for at least substantially covering a portion of the plurality of evaporator coils and coupled to the display case frame. The coil cover includes a planar member having a top side, a bottom side, a front end, a back end, a first side end, and a second side end. The coil cover also includes a living hinge formed in the planar member extending from the first side end to the second end and defining a first portion of the planar member and a second portion of the planar. The living hinge is configured to allow movement between the first portion of the planar member and the second portion of the planar member. The coil cover also includes an attachment member for coupling the coil cover to the display case frame. The coil cover may also include a sealing member and a releasable holding member. Other embodiments and designs are presented further below.

BRIEF DESCRIPTION

Reference is now made to the following descriptions taken in conjunction with the accompanying drawings, in which.

DETAILED DESCRIPTION

Figure 1:
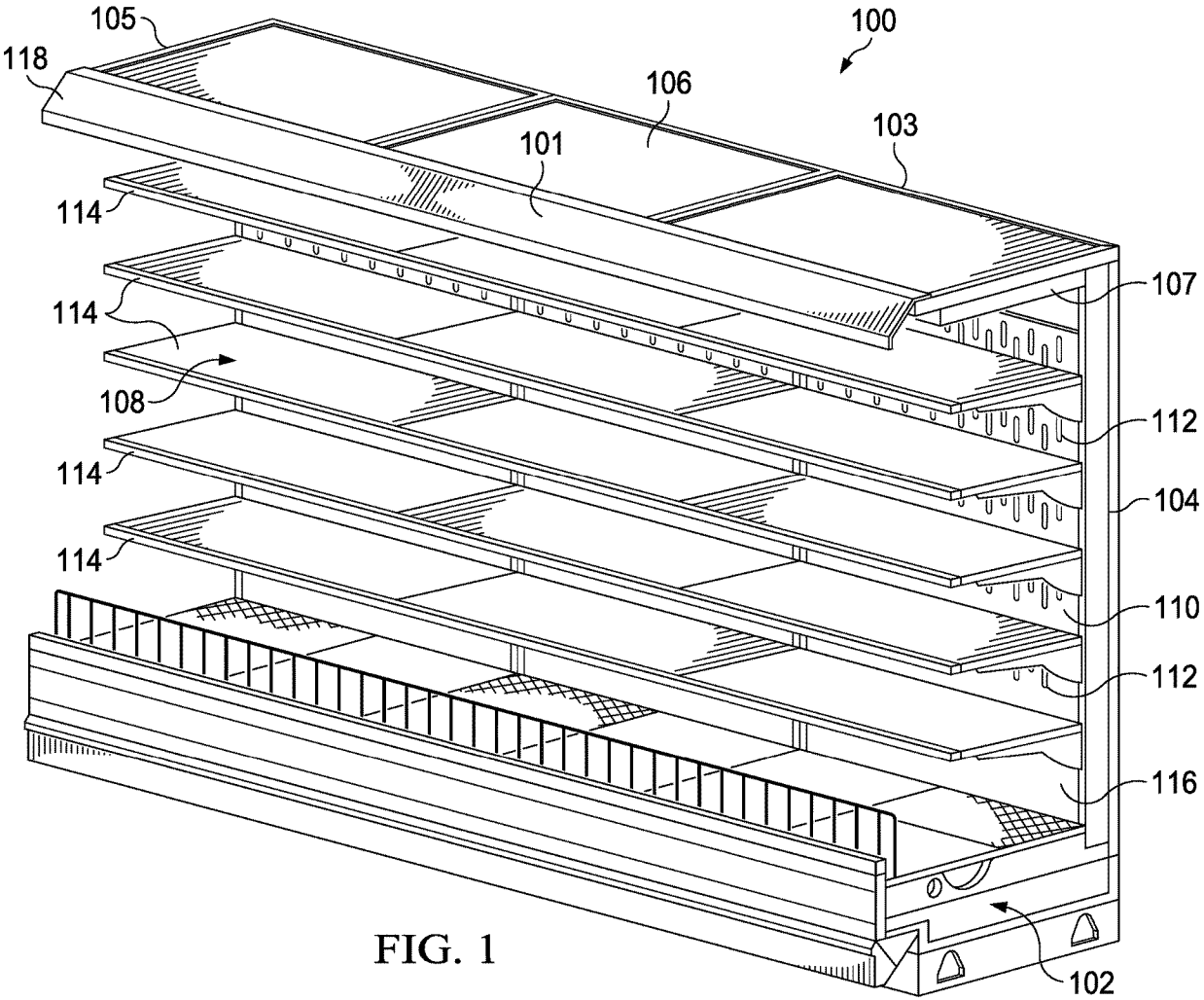
FIG. 1 is a schematic perspective view of a refrigeration display case.

Referring now to the figures, and initially and primarily to FIG. 1, a refrigeration display case 100 for refrigerating and displaying perishable goods is presented. The refrigeration display case 100 includes a base member 102 and a back wall 104 coupled to the base member 102. The refrigeration display case 100 has a front 101, a back 103, a first side 105, and a second side 107. The refrigeration display case 100 has a top member 106 coupled to the back wall 104. The base member 102, back wall 104, and top member 106 form an interior display area 108 in which the perishable goods are displayed. A front portion is open to the interior display area 108 and allows a consumer to reach in to obtain perishable goods in the interior display area 108.

The back wall 104 may include a baffle panel 110 formed with a plurality of baffle apertures to allow the cooled air to exit a portion of the back wall 104 at various locations of the interior display area 108. A plurality of shelves 114 is coupled to the back wall 104 for supporting perishable goods to be displayed. A rack member 116 may be attached to a lower portion of the back wall 104 or to the base member 102.

The top member 106 may be coupled substantially perpendicular to the back wall 104. The top member 106 may include baffle member 118 to direct a curtain of air downward (for orientation shown) toward the base member 102 where it may be cooled and re-circulated. The cooled airflow is directed along the back wall 104 with portions being distributed through the baffle apertures 112 to various locations within the interior display area 108 and a portion being directed from the back wall 104 along an interior portion of the top member 106 and with the help of the baffle member 118 down the front portion of the interior display area 108 to the base member 102.

Figure 2:
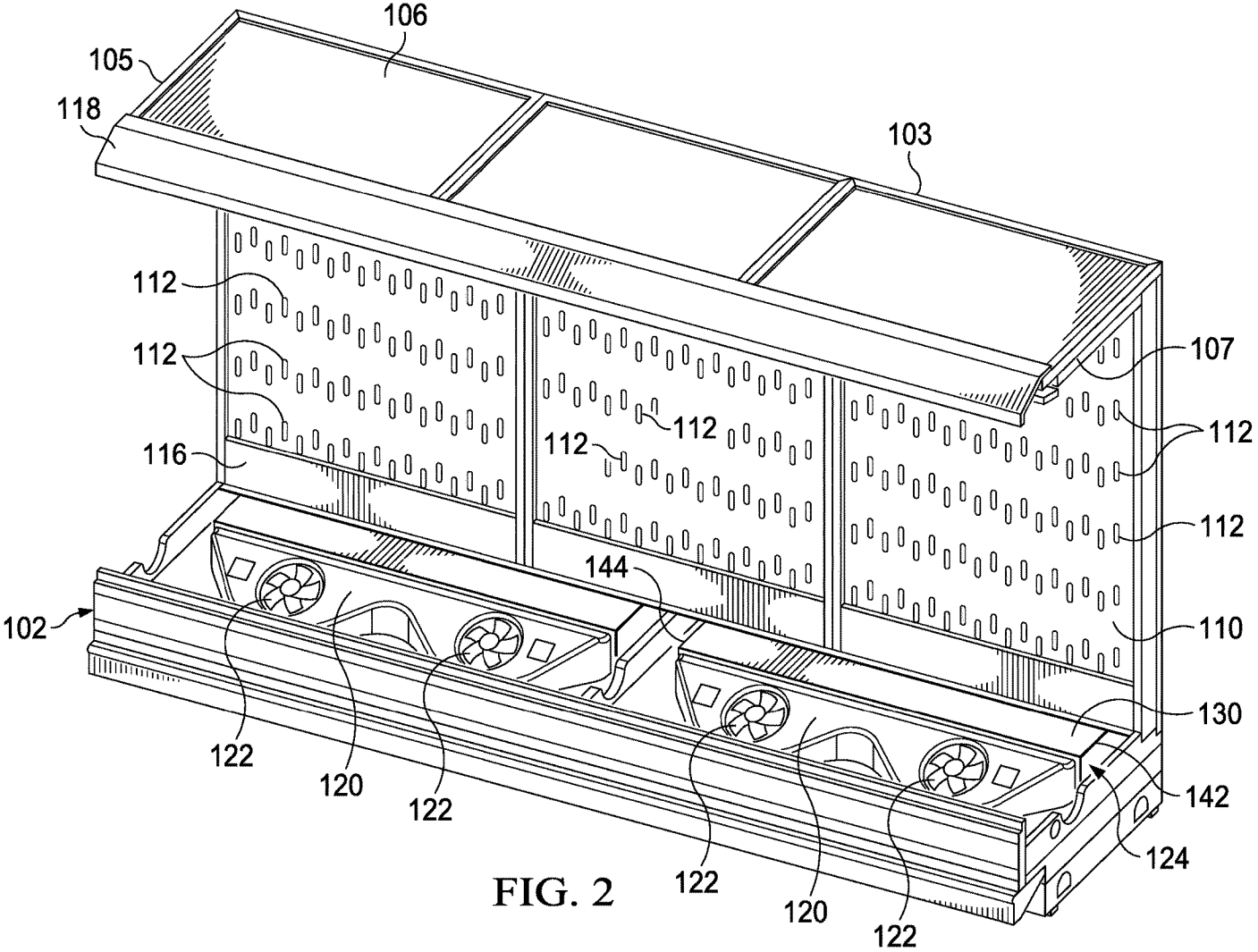
FIG. 2 is a schematic perspective view of the refrigeration display case of FIG. 1 with a portion removed.
Figure 3:
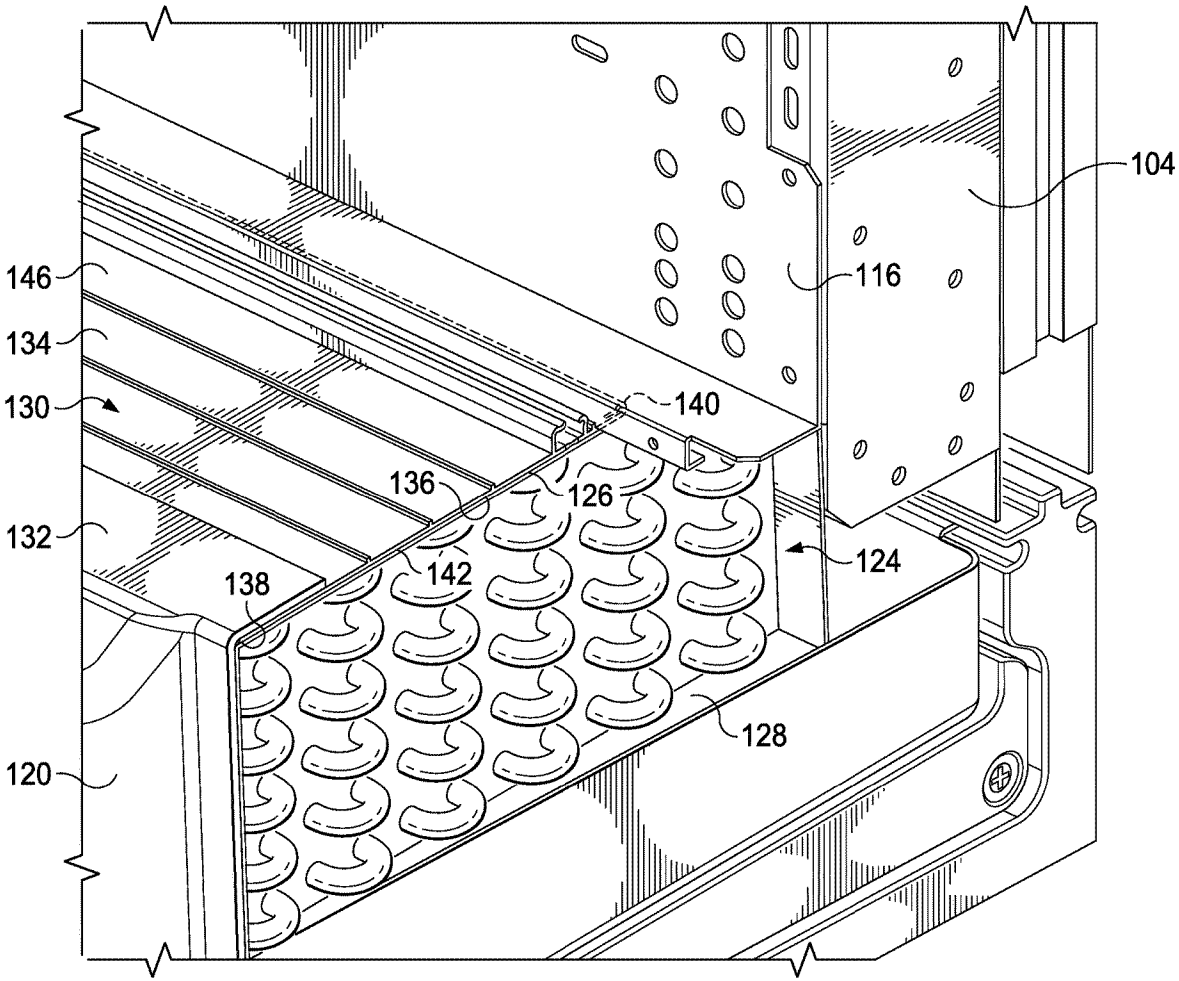
FIG. 3 is a schematic perspective view of a portion of a base member and back wall showing a portion of a coil cover over a plurality of evaporator coils.

Referring now primarily to FIGS. 2 and 3, the base member 102 may take numerous configurations but includes at least one fan plenum 120 associated with at least one fan 122, and a plurality of evaporator coils 124 having a top portion 126 and a bottom portion 128. The base member 102 also includes a coil cover 130. The at least one fan plenum 120 and at least one fan 122 are configured to direct air over the plurality of evaporator coils 124. As an aspect of maintaining the refrigerator display case 100, the evaporator coils 124 must be accessed for cleaning or other work from time to time. In the past, this may have required complicated disassembly or expensive access devices to be added, but a more efficient way of accessing the evaporator coils is presented herein.

Referring now primarily to FIG. 3, a portion of the fan plenum 120 is shown with plenum ledge 132 extending over a portion of the coil cover 130. The coil cover 130 has a first (or top) side 134, a second (or bottom) side 136, a first end 138, a second end 140, a first side end 142 and a second side end 144 (opposite first side end 142 and shown in FIG. 2). The first end 138 of the coil cover 130 may extend under a portion of the plenum ledge 132 to form a substantially air tight seal there between. One or more sealing members may be applied between the plenum ledge 132 and the coil cover 130. The second end 140 of the coil cover may be coupled to the back wall 104 or a portion of the base member 102. The plurality of coils 124 may be a single multi-tum coil or more than one multi-tum coil. The coil cover 130 includes a substantially planar member 146 that is sized and configured to substantially cover the top portion 126 of the plurality of evaporator coils 124.

Figure 4:
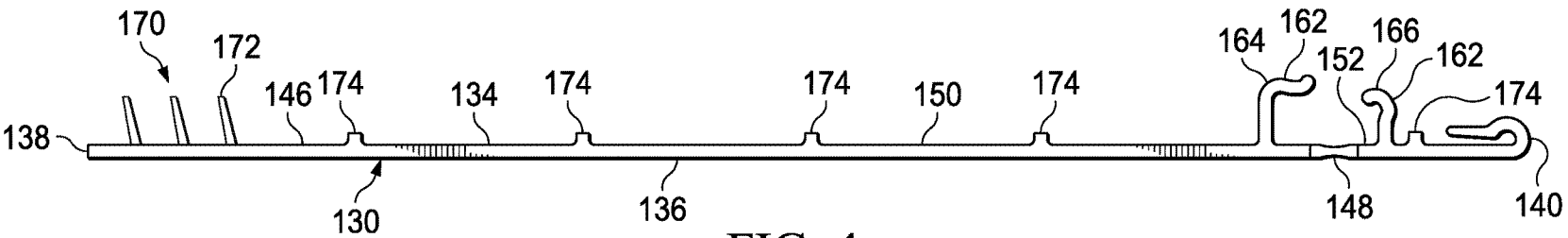
FIG. 4 is a schematic cross section view of an illustrative embodiment of a coil cover.
Figure 5:
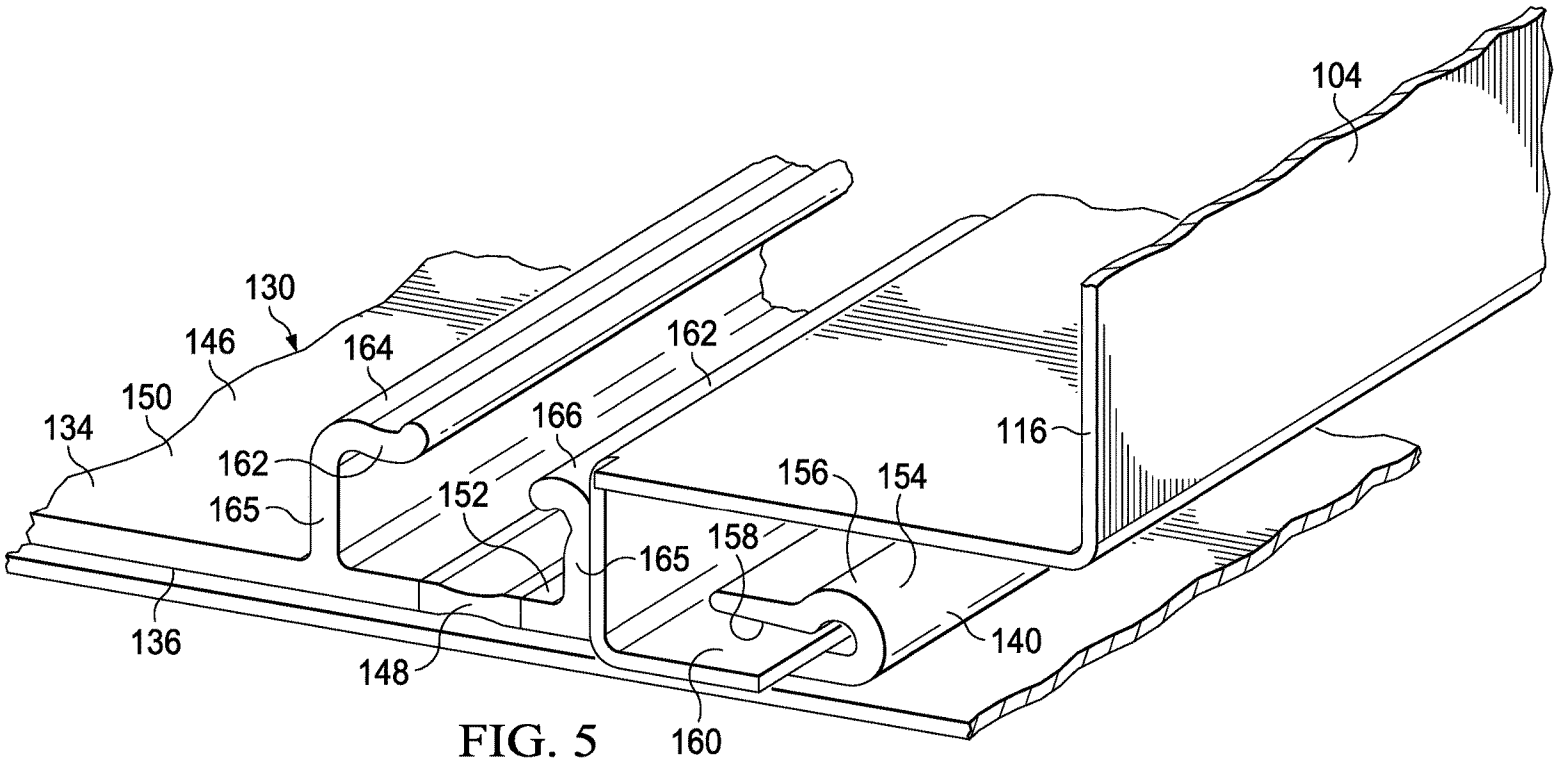
FIG. 5 is a schematic perspective view of a portion of a coil cover coupled to a base member or back wall by a rack member.

Referring now to FIGS. 4 and 5, additional aspects of the coil cover 130 will be presented. As previously noted, the evaporator coils 124 must be accessed for cleaning or other work from time to time. This is accomplished in the present embodiment by incorporating a living hinge 148. The living hinge 148 is formed in the planar member 146 and extends laterally from the first side end 142 (FIG. 2) to the second (opposite) side end 144 (FIG. 2) for allowing a first portion 150 of the planar member 146 to assume an angle greater than 45 degrees with respect to a second portion 152 of the planar member 146. The living hinge 148, or integral hinge, is typical a relatively thin, flexible web that connects two planar portions and allows movements of those two portions relative to each other. The living hinge 148 may be injection molded, extruded/co-extruded, or produced by stamping or machining to reduce or compress material.

An attachment member 154 is coupled to the second end 140 of the planar member 146 for coupling the planar member 146 to the base member 102 or back wall 104. In the embodiment of FIG. 5, the attachment member 154 is a J-hook 156. The J-hook 156 has a slot 158 that receives a ledge member 160. It should be appreciated that while a "J-hook" is mentioned, one skilled in the art will appreciate that numerous other shapes might be used to lock into or with ledge member 160. The ledge member 160 is coupled to the rack member 116 or otherwise to the base member 102 or back wall 104 by a weld, fastener, or other technique.

The coil cover 130 may also include a releasable holding device 162 for holding the first portion 150 of the planar member 146 in a position angled to the second portion 152 of the planar member 146. In other words, the coil cover 130 may be pivoted about hinge 148 to assume an open position and then held open by the releasable holding device 162 while cleaning or maintenance is performed on the plurality of coils 124. In one embodiment, the releasable holding device 162 includes a first member 164 extending from the first portion 150 of the planar member 146 and having a at least a portion 165 that is substantially orthogonal to the first portion 150 and a second member 166 extending from the second portion 152 and having at least a portion extending substantially orthogonal to the second portion 152. It will be appreciated that the releasable holding device 162 and first member 164 may take different configurations to provide a desired locking or holding action. With this embodiment, the movement about the living hinge 148 causes the first member 164 and the second member 166 to engage each other with an interference fit to hold a relative position between the first portion 150 of the planar member 146 and the second portion 152 of the planar member 146.

As previously noted, a sealing member may be used to help form a substantially airtight seal between the coil cover 130 and the fan plenum 120. As shown in FIG. 4, the sealing member 170 may be formed on the first end 138 of the coil cover 130 for interfacing with the at least one fan plenum 120. The sealing member 170 may be a plurality of flexible barb members 172.

The coil cover 130 may be formed from various materials but the living hinge 148 must allow the cover 130 to rotate as described herein. Typically, the living hinge 148 will be formed from the same material as the planar member 146 although may be thinner. For example, in one embodiment, the planar member 146 and living hinge 148 are formed from plastic and the living hinge 148 is a thinner portion. In one illustrative non-limiting example, the living hinge 148 portion may be half as thick as the planar member 146. In one illustrative, non-limiting embodiment, the coil cover 130 is formed from co-extrusion of rigid/flexible polyvinyl chloride (PVC). Alternate material can be substituted for PVC including, different grades of thermoplastics like ABS (Acrylonitrile butadiene styrene), HDPE (High-density polyethylene), etc., as well as composite materials. The coil cover 130 can also take different forms/shapes and include different colors. In another embodiment, the living hinge 148 may be made from a different material and attached between the two portions 150, 152. Depending on the material, it may be desirable to add a plurality of stiffening ribs 174 as shown in FIG. 4.

Figure 7:
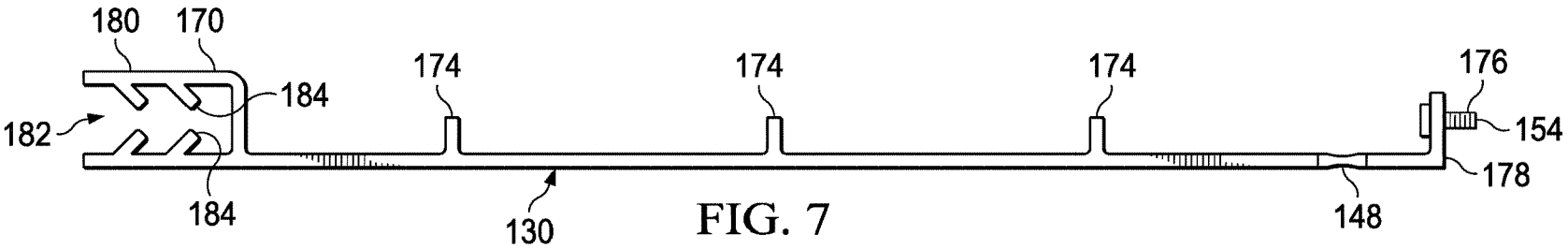
FIG. 7 is a schematic cross section view of still another illustrative embodiment of a coil cover.

Referring now to FIG. 7, a cross section of an alternative embodiment of a coil cover 130 is presented. In this embodiment, the attachment member 154 is a screw 176 that can go through a vertical member 178 and into a portion of the back wall 104 or base member 102 (or coupling member). In this embodiment, the sealing member 170 comprises a sealing cavity member 180 having a cavity 182 with flexible barbs 184 for receiving a portion of the fan plenum. While schematic in nature, it should be appreciated that the living hinge 148 may be formed between 80 and 100 percent of the distance from the first end 138 to the second end 140 of the planar member 146.

Figure 6:
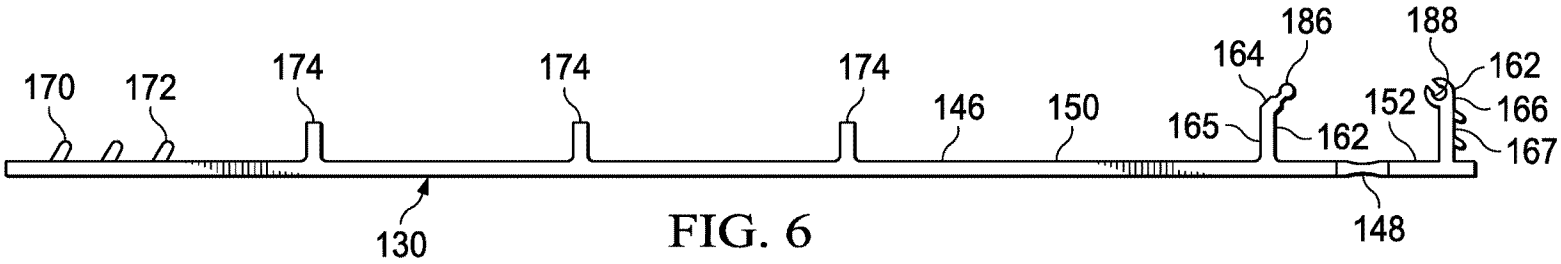
FIG. 6 is a schematic cross section view of another illustrative embodiment of a coil cover.

Referring now to FIG. 6, a cross section of an alternative embodiment of a coil cover 130 is presented. In this embodiment, the releasable holding device 162 includes a first member 164 and a second member 166 that comprise a ball and socket. As shown, in this embodiment, the first member 164 includes a ball 186 and the second member 166 includes a socket 188.

As used herein, the term "coupled" includes coupling via a separate object and includes direct coupling. The term "coupled" also encompasses two or more components that are continuous with one another by virtue of each of the components being formed from the same piece of material or associated one to another by a magnetic field.

The present invention and its advantages have been disclosed in the context of certain illustrative, non-limiting embodiments. The illustrative descriptions above are not intended to be exhaustive or to limit the invention to the precise forms disclosed. Moreover, it should be understood that various changes, substitutions, permutations, and alterations can be made without departing from the scope of the invention as defined by the appended claims. It will be appreciated that any feature that is described in connection to any one embodiment may also be applicable to any other embodiment.

What is claimed is:

1. A refrigeration display case for refrigerating and displaying perishable goods, the refrigeration display case comprising:

a base member;

a back wall coupled to the base member; a top member coupled to the back wall;

the base member, back wall, and top member forming an interior display area in which the perishable goods are displayed;

the base member comprising:

at least one fan plenum associated with at least one fan, a plurality of evaporator coils have a top portion and a bottom portion, a coil cover, and wherein the at least one fan plenum and at least one fan are configured to direct air over the plurality of evaporator coils; and wherein the coil cover comprises:

a planar member having a first end, a second end, a first side end, and a second side end, the planar member covering a portion of the top portion of the plurality of evaporator coils, an attachment member coupled to the second end of the planar member for coupling the planar member to the base member or back wall, a living hinge formed in the planar member and extending from the first side end to the second side end, wherein a first portion of the planar member may rotate or move to an angle greater than 45 degrees relative to a second portion of the planar member.

2. The refrigeration display case of claim 1, wherein the coil cover further comprises a releasable holding device for holding the first portion of the planar member in a position angled to the second portion of the planar member.

3. The refrigeration display case of claim 2, wherein the releasable holding device comprises:

a first member extending from the first portion of the planar member, the first member having at least a portion that is substantially orthogonal to the first portion; and a second member extending from the second portion, the second member having at least a portion extending substantially orthogonal to the second portion;

wherein movement about the living hinge will cause the first member and the second member to engage each other with an interference fit to hold a relative position between the first portion of the planar member and the second portion of the planar member.

4. The refrigeration display case of claim 2, wherein the releasable holding device comprises:

a first member extending from the first portion of the planar member, the first member having at least a portion that is substantially orthogonal to the first portion; and a second member extending from the second portion, the second member having at least a portion extending substantially orthogonal to the second portion;

wherein movement about the living hinge will cause the first member and the second member to engage each other with one having a ball and one a socket.

5. The refrigeration display case of claim 1, wherein the coil cover further comprises a sealing member formed on the first end of the planar member for interfacing with the at least one fan plenum.

6. The refrigeration display case of claim 5, wherein the sealing member comprises a plurality of flexible barbs extending from a first surface of the planar member proximate the first end of the planar member.

7. The refrigeration display case of claim 1, wherein the attachment member comprises a J-hook formed on the second end.

8. The refrigeration display case of claim 1, wherein the attachment member comprises a screw.

9. The refrigeration display case of claim 1, wherein the planar member comprises a plastic material and further comprises a plurality of stiffening ribs.

10. The refrigeration display case of claim 1, wherein the living hinge extends along 80 to 100 percent of a length from the first end to the second end of the planar member.

11. The refrigeration display case of claim 1, wherein the living hinge extends along 80 to 95 percent of a length from the first end to the second end of the planar member.

12. The refrigeration display case of claim 1, wherein the living hinge is formed from the same material as the planar member.

13. The refrigeration display case of claim 12, wherein the living hinge is formed from the same material as the planar member and has a thickness that is less than half of thickness of the planar member.

14. The refrigeration display case of claim 1, wherein the living hinge is formed from a material that is different from a material from which the planar member is formed.

15. The refrigeration display case of claim 1, wherein the coil cover further comprises a releasable holding device for holding the first portion of the planar member in a position angled to the second portion of the planar member;

wherein the coil cover further comprises a sealing member formed on the first end of the planar member for interfacing with the at least one fan plenum;

wherein the sealing member comprises a plurality of deformable barbs extending from a first surface of the planar member proximate the first end of the planar member;

wherein the attachment member comprises a J-hook formed on the second end;

wherein the planar member comprises a plastic material and further comprises a plurality of stiffening ribs; and wherein the living hinge extends along 80 to 100 percent of a length from the first end to the second end of the planar member.

16. A refrigeration display case for refrigerating and displaying perishable goods, the refrigeration display case comprising:

a plurality of evaporator coils for cooling air; a display case frame forming a display area;

a coil cover that covers a portion of the plurality of evaporator coils and coupled to the display case frame; and wherein the coil cover comprises:

a planar member having a top side, a bottom side, a front end, a back end, a first side end, and a second side end, a living hinge formed in the planar member extending from the first side end to the second side end and defining a first portion of the planar member and a second portion of the planar member, and wherein the living hinge is configured to allow movement between the first portion of the planar member and the second portion of the planar member, and an attachment member for coupling the coil cover to the display case frame.

17. The refrigeration display case of claim 16, further comprising a sealing member coupled to the top side of the planar member proximate the front end.

18. The refrigeration display case of claim 16, further comprising a releasable holding device having a first releasable holding member formed on the first portion of the planar member and a second releasable holding member formed on the second portion of the planar member, and wherein the first releasably holding member and the second releasable holding member are configured to releasable couple to one another to hold the first portion of the planar member at an angle to the second portion of the planar member.

19. The refrigeration display case of claim 18, wherein the first releasable holding member and second releasable holding member comprise a ball and socket.

20. The refrigeration display case of claim 16, further comprising:

a sealing member coupled to the top side of the planar member proximate the front end; and a releasable holding device having a first releasable holding member formed on the first portion of the planar member and a second releasable holding member formed on the second portion of the planar member, and wherein the first releasable holding member and the second releasable holding member are configured to releasably couple to one another to hold the first portion of the planar member at an angle to the second portion of the planar member.

* * * * *